US010352531B2

(12) United States Patent
Yeh et al.

(10) Patent No.: US 10,352,531 B2
(45) Date of Patent: Jul. 16, 2019

(54) OPTICAL DIFFUSION PLATE AND LIGHT SOURCE MODULE

(71) Applicant: Coretronic Corporation, Hsin-Chu (TW)

(72) Inventors: Fang-Ju Yeh, Hsin-Chu (TW); Jin-Rang Liu, Hsin-Chu (TW); Hsin-Hung Lee, Hsin-Chu (TW); Chiao-Chih Yang, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 61 days.

(21) Appl. No.: 15/201,625

(22) Filed: Jul. 5, 2016

(65) Prior Publication Data

US 2017/0159908 A1 Jun. 8, 2017

(30) Foreign Application Priority Data

Dec. 3, 2015 (CN) ..... 2015 1 087344

(51) Int. Cl.
*F21V 7/00* (2006.01)
*F21V 5/04* (2006.01)
(Continued)

(52) U.S. Cl.
CPC ..... *F21V 7/0025* (2013.01); *F21V 5/04* (2013.01); *F21V 3/06* (2018.02); *F21V 7/0066* (2013.01); *F21V 13/04* (2013.01)

(58) Field of Classification Search
USPC ..... 362/305
See application file for complete search history.

(56) References Cited

U.S. PATENT DOCUMENTS 7,513,632 B2 * 4/2009 Kim ..... G02B 6/0021 362/23.12
2010/0214432 A1 * 8/2010 Nakata ..... H01L 27/14627 348/222.1
2011/0157889 A1 * 6/2011 Chang ..... G02B 5/0215 362/235

FOREIGN PATENT DOCUMENTS

CN 101000427 7/2007
CN 102644883 8/2012
(Continued)

OTHER PUBLICATIONS

"Office Action of China Counterpart Application", dated Sep. 25, 2018, p. 1-p. 8.

*Primary Examiner* — Michael G Lee
*Assistant Examiner* — David Tardif
(74) *Attorney, Agent, or Firm* — JCIPRNET

(57) ABSTRACT

An optical diffusion plate and a light source module are provided. The optical diffusion plate includes a light incident surface, a light emitting surface, at least one pattern region, and a reflection layer. The pattern region is located on at least one of the light incident surface and the light emitting surface. The reflection layer covers a portion of the pattern region. The pattern region includes a central region located at a central position, a plurality of first circular regions, and at least one second circular region. The central region is surrounded by the first circular regions and the second circular region alternatively, and perimeter of the central region is adjacent to one of the first circular regions. Coverage rates of the reflection layer at the second circular region and the central region are higher than coverage rates of the reflection layer at the first circular regions.

15 Claims, 5 Drawing Sheets

(51) Int. Cl.
*F21V 13/04* (2006.01)
*F21V 3/06* (2018.01)

(56) References Cited

FOREIGN PATENT DOCUMENTS

| | | |
|---|---|---|
| CN | 102767786 | 11/2012 |
| CN | 202813043 | 3/2013 |
| CN | 103592705 | 2/2014 |
| CN | 105757527 | 7/2016 |
| TW | 201122672 | 7/2011 |
| TW | I406057 | 8/2013 |

* cited by examiner

OPTICAL DIFFUSION PLATE AND LIGHT SOURCE MODULE

CROSS-REFERENCE TO RELATED APPLICATION

This application claims the priority benefit of China application serial no. 201510873446.X, filed on Dec. 3, 2015. The entirety of the above-mentioned patent application is hereby incorporated by reference herein and made a part of this specification.

BACKGROUND OF THE INVENTION

Field of the Invention

The invention relates to an optical device and an optical apparatus, and particularly relates to an optical diffusion plate and a light source module.

Description of Related Art

With the development of optical technology, light beam provided by a conventional backlight module can be used for lighting application or as the desired light source of the LCD display screen. In the conventional backlight module, a direct type backlight module can provide sufficient light beam to illuminate a large-sized display panel, and thus the large-sized display panel can display a good image.

In the current research and development objectives in the display technology, a thin display device having a high luminance has been one of the main issues currently. However, when the thickness of the display device is decreased, the distance between the light source in the direct type backlight module and the display panel may be decreased, so that the light beam emitted from the light source may not provide a uniform lighting effect. The conventional direct type backlight module may adjust the light beam by the optical lens, so that the light beam emitted from each light source can illuminate a larger region. However, when the thickness of the display device is further decreased, the distribution density of the light source and the optical lens is increased accordingly. Additionally, the light source and the optical lens in a high density not only decrease the manufacturing yield of the display device, but also increase the manufacturing cost of the display device at the same time.

The information disclosed in the "BACKGROUND OF THE INVENTION" section is only for enhancement of understanding of the background of the described technology and therefore it may contain information that does not form the prior art that is already known to a person of ordinary skill in the art. Further, the information disclosed in the "BACKGROUND OF THE INVENTION" section does not mean that one or more problems to be resolved by one or more embodiments of the invention was acknowledged by a person of ordinary skill in the art.

SUMMARY OF THE INVENTION

The invention provides an optical diffusion plate. The optical diffusion plate diffuses light beam from light source so as to provide uniform illumination light.

The invention provides a light source module. The light source module provides uniform illumination light when the thickness thereof is decreased.

Other objects and advantages of the invention may be further illustrated by the technical features broadly embodied and described as follows.

In order to achieve one or a portion of or all of the objects or other objects, one embodiment of the invention provides an optical diffusion plate including a light incident surface, a light emitting surface being opposite to the light incident surface, at least one pattern region, and a reflection layer. The pattern region is located on at least one of the light incident surface and the light emitting surface. The reflection layer covers at least a portion of the pattern region. The pattern region includes a central region located at a central position of the pattern region, a plurality of first circular regions, and at least one second circular region. The central region is surrounded by the first circular regions and the second circular region alternatively, and perimeter of the central region is adjacent to one of the first circular regions. Coverage rates of the reflection layer at the at least one second circular region and the central region are higher than coverage rates of the reflection layer at the first circular regions.

In order to achieve one or a portion of or all of the objects or other objects, one embodiment of the invention provides a light source module including the aforementioned optical diffusion plate and at least one light emitting device. The light emitting device is disposed at one side of the optical diffusion plate near the light incident surface, and a position of the light emitting device corresponds to the pattern region.

The embodiments of the invention have at least one of the following advantages or effects. The optical diffusion plate of the embodiments of the invention has the reflection layer covering the pattern region of the light incident surface or the light emitting surface. Thus, the light beam transmitted from outside to the pattern region may be reflected by the reflection layer, so that the light beam emitted from the light incident surface may have a good uniformity. Since the light source module of the embodiments of the invention has the aforementioned optical diffusion plate, the distance between the light emitting device and the optical diffusion plate may be decreased. Therefore, it can provide good illumination light beam when the thickness of the overall light source module is decreased.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1A:
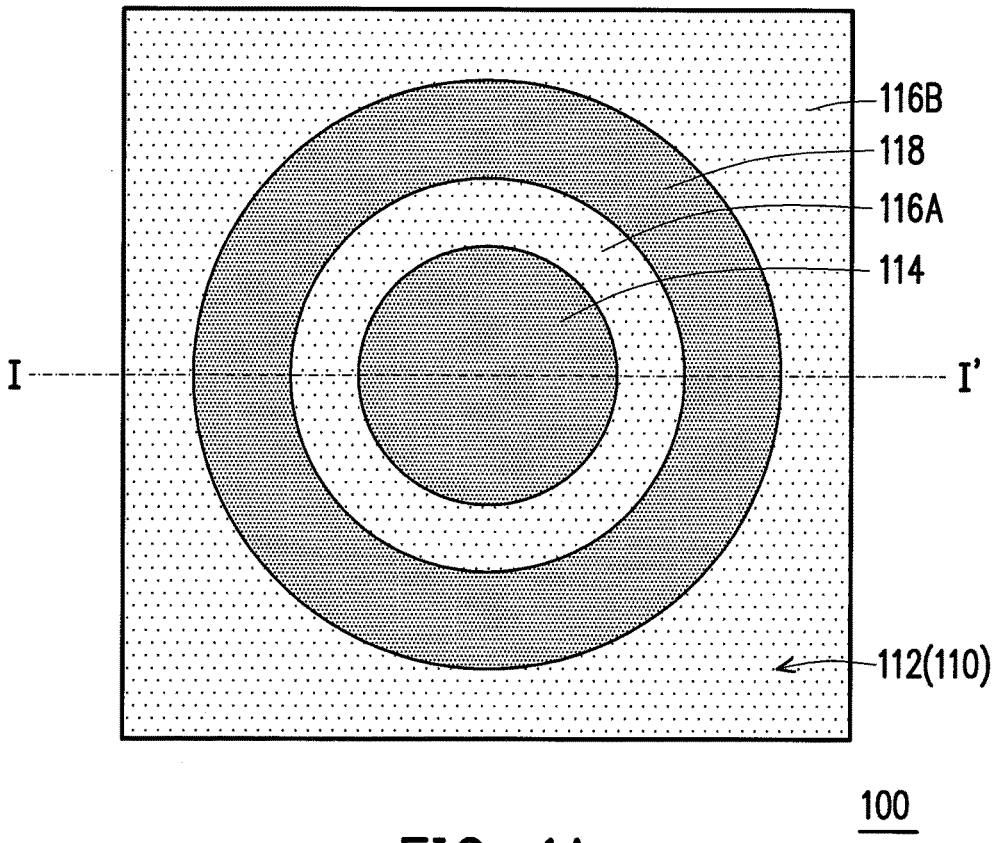
FIG. 1A is a schematic bottom view of an optical diffusion plate according to a first embodiment of the invention.
Figure 1B:
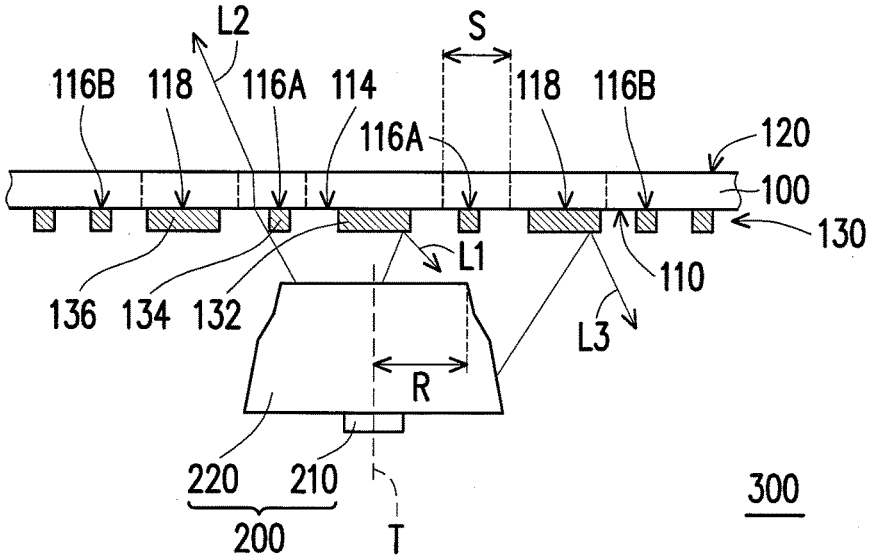
FIG. 1B is a partial schematic cross-sectional view of a light source module according to the first embodiment of the invention.

The optical diffusion plate of the embodiments of the invention is used to transmit a portion of light beam and reflect another portion of light beam, so that the light beam may have a good uniformity when the light beam is transmitted to the other side of the optical diffusion plate. FIG. 1A is a schematic bottom view of an optical diffusion plate according to a first embodiment of the invention. FIG. 1B is a partial schematic cross-sectional view of a light source module according to the first embodiment of the invention, wherein an optical diffusion plate 100 in FIG. 1B is represented according to the line I-I' in FIG. 1A. Referring to FIG. 1A and FIG. 1B, in the first embodiment of the invention, the optical diffusion plate 100 includes a light incident surface 110, a light emitting surface 120, at least one pattern region 112, and a reflection layer 130, the light emitting surface 120 is opposite to the light incident surface 110. The pattern region 112 is located on the light incident surface 110 or the light emitting surface 120 or located on both the light incident surface 110 and the light emitting surface 120. In the embodiment, the pattern region 112 located on the light incident surface 110 is illustrated as an example. The pattern region 112 includes a central region 114 located at a central position, first circular regions 116A and 116B, and a second circular region 118. The central region 114 is surrounded by the first circular region 116A, the second circular region 118, and the first circular region 116B alternatively, and perimeter of the central region 114 is adjacent to the first circular region 116A. In particular, in the embodiment, the central region 114, the first circular region 116A, the second circular region 118, and the first circular region 116B are sequentially arranged in the pattern region 112 in a direction from the central position to the outside (away from the central position).

In the embodiment, the reflection layer 130 covers at least a portion of the pattern region 112. The coverage rates of the reflection layer 130 at the central region 114 and the second circular region 118 are higher than the coverage rates of the reflection layer 130 at the first circular regions 116A and 116B. That is, a ratio of the area covered by the reflection layer 130 at the central region 114 to the total area of the central region 114 is higher than ratios of the area covered by the reflection layer 130 at the first circular regions 116A and 116B to the total area of the first circular regions 116A and 116B, and a ratio of the area covered by the reflection layer 130 at the second circular region 118 to the total area of the second circular region 118 is higher than the ratios of the area covered by the reflection layer 130 at the first circular regions 116A and 116B to the total area of the first circular regions 116A and 116B.

Referring to FIG. 1B, a light source module 300 of the embodiment further includes a light emitting device 200. The light emitting device 200 is disposed at one side of the optical diffusion plate 100 near the light incident surface 110, and the position of the light emitting device 200 corresponds to the pattern region 112. By the setting of the reflection layer 130 on the central region 114, the first circular region 116A, the second circular region 118, and the first circular region 116B of the pattern region 112 of the light incident surface 110, and the coverage rates of the reflection layer 130 at the central region 114 and the second circular region 118 higher than the coverage rates of the reflection layer 130 at the first circular regions 116A and 116B, the reflection rate of the overall optical diffusion plate 100 at the central region 114 and the second circular region 118 is higher while the reflection rate of that at the first circular regions 116A and 116B is lower. Thus, a light beam emitted from the light emitting device 200 is transmitted to the central region 114 and the second circular region 118, a portion of the light beam in a higher ratio is reflected. Thereby, the light beam emitted from the light emitting surface 120 of the optical diffusion plate 100 has a good uniformity.

Specifically, referring to FIG. 1B, when a portion of light beam L1 emitted from the light emitting device 200 is transmitted to the central region 114, since the region of the central region 114 covered by the reflection layer 130 is larger, the higher ratio of the light beam L1 is reflected. When a portion of light beam L2 emitted from the light emitting device 200 is transmitted to the first circular region 116A, since the region of the first circular region 116A covered by the reflection layer 130 is smaller, the higher ratio of the light beam L2 enters the optical diffusion plate 100. When a portion of light beam L3 emitted from the light emitting device 200 is transmitted to the second circular region 118, since the region of the second circular region 118 covered by the reflection layer 130 is larger, the higher ratio of the light beam L3 is reflected.

In the embodiment, since the pattern region 112 of the light incident surface 110 of the optical diffusion plate 100 has the reflection layer 130 thereon, and the reflection rate of the pattern region 112 is arranged in a way of being high, low, high, and low from inside to outside in sequence, the optical diffusion plate 100 may further compensate the luminance distribution of the light beam irradiated on the light incident surface 110 from light source when the light beam emitted from the light emitting device 200 is transmitted to the light incident surface 110. Therefore, the light beam uniformly penetrates the light incident surface 110. In particular, when the light emitting device 200 provides light beams L1, L2 and L3 to the light incident surface 110, since the light beams L1, L2 and L3 which are irradiated to different regions of the light incident surface 110 may have different light intensity distribution, a light spot is formed. The distribution of the reflection layer 130 on the pattern region 112 may make a portion of the light beam on the region with a lower light intensity (i.e. the first circular regions 116A and 116B) penetrate the light incident surface 110 in a higher ratio, and at the same time, a portion of the light beam on the region with a higher light intensity (i.e. the central region 114 and the second circular region 118) penetrate the light incident surface 110 in a lower ratio. Therefore, the overall light beam enters the optical diffusion plate 100 uniformly, and thus the light beam emitted from the light emitting surface 120 may have a good uniformity.

Figure 2:
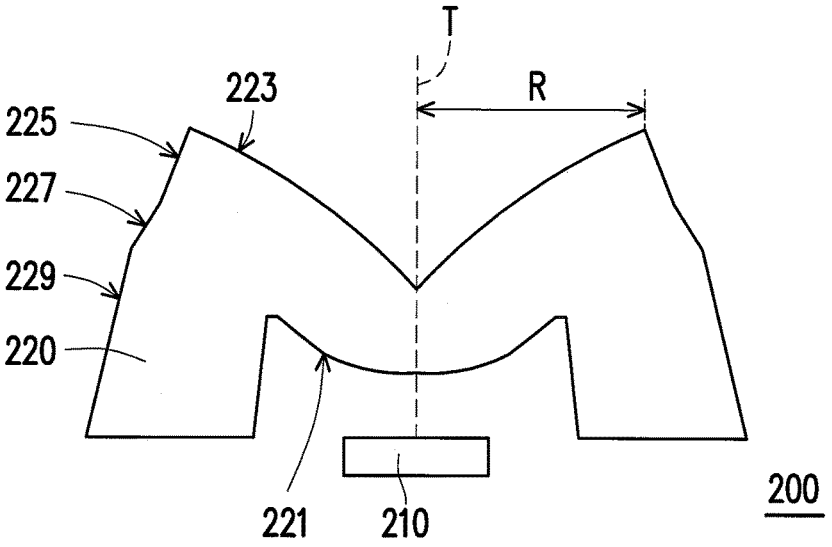
FIG. 2 is a schematic cross-sectional view of a light emitting device according to the first embodiment of the invention.

FIG. 2 is a schematic cross-sectional view of a light emitting device according to the first embodiment of the invention. Referring to FIG. 2, in the first embodiment of the invention, the light emitting device 200 includes a light emitting unit 210 and an optical lens 220. The light emitting unit 210 is capable of emitting a light beam entering a light incident surface 221 of the optical lens 220. The optical lens 220 further has a light emitting concave surface 223 opposite to the light incident surface 221, and light emitting curved surfaces 225, 227 and 229. The light beam emitted from the light emitting unit 210 enters the light incident surface 221, and then the light beam is emitted from the light emitting concave surface 223, and the light emitting curved surfaces 225, 227 and 229. Thus, the light emitting angle of the overall light beam is increased. In particular, the light emitting unit 210 of the first embodiment of the invention is a light emitting diode (LED), for example. However, the invention is not limited thereto. In other embodiments, the light emitting device may be an organic light emitting diode (OLED), a laser diode, or other light emitting unit capable of being the light source. On the other hand, the optical lens 220 of the first embodiment of the invention is, for example, a secondary lens. The optical lens 220 is used for refraction and reflection of the light beam from the light emitting unit 210, and thus the light beam is emitted in a larger light emitting angle. However, referring to FIG. 1B accordingly, since the optical lens 220 makes the light beam projected to the light incident surface 110 have a specific light spot (that is, the different regions on the light incident surface 110 may be irradiated by the light beam with different intensity), a portion of the light beam with the intensity which is too strong may be reflected appropriately by the reflection layer 130 on the pattern region 112 while the light beam with lower intensity may be penetrated. Therefore, the optical diffusion plate 100 may provide a good diffusion function and uniformization function.

Referring to FIG. 1B, the optical diffusion plate 100 of the embodiment is, for example,s a light guild plate or a diffusion plate. The optical diffusion plate 100 is formed by a light transparent material for transmitting the light beam. The material or the color thereof, which is not limited to the invention, is determined depending on the property of the light beam received by the optical diffusion plate 100 and the desired optical effect shown by the light source module 300. In other embodiments, the optical diffusion plate 100 may further include diffusion particles doped therein; however, the invention is not limited thereto.

Referring to FIG. 1A and FIG. 1B, in the first embodiment of the invention, the reflection layer 130 includes a plurality of reflection patterns 132, 134 and 136 disposed in the pattern region 112. The region occupied by the reflection pattern 132 in a unit area of the central region 114 is more than the regions occupied by the reflection patterns 134 in a unit area of the first circular regions 116A and 116B, and the regions occupied by the reflection patterns 136 in a unit area of the second circular region 118 is more than the region occupied by the reflection patterns 134 in the unit area of the first circular regions 116A and 116B. In particular, in the optical diffusion plate 100 of the embodiment, the area of the light incident surface 110 covered by the reflection layer 130 in the unit area of the central region 114 and the second circular ti region 118 is larger, and the area of the light incident surface 110 covered by the reflection layer 130 in the unit area of the first circular regions 116A and 116B is smaller. Therefore, the reflection rate of the optical diffusion plate 100 at the side near the light incident surface 110 may appropriately compensate the light beam from the light emitting device 200.

Referring to FIG. 1B, in the first embodiment of the invention, the central position (i.e. the central region 114) of the pattern region 112 is located on a main optical axis T of the optical lens 220, and the light emitting unit 210 is also approximately disposed on the main optical axis T. Therefore, the light pattern of the light beam emitted from the light emitting device 200 at the light incident surface 110 corresponds to the position of the central region 114, the first circular regions 116A and 116B, and the second circular region 118 at the pattern region. In particular, the intensity of the light beam irradiated to the light incident surface 110 is positively correlated with the coverage rate of the reflection layer 130 at the light incident surface 110 substantially, and the positive correlation refers to that a higher intensity of the light beam irradiated to the light incident surface 110, a higher coverage rate of the reflection layer 130 at the light incident surface 110. Therefore, the reflection layer 130 may reflect the light beam irradiated to the light incident surface 110 with a higher intensity, thereby increasing the light source uniformity of the light source module 300.

Furthermore, in the first embodiment of the invention, the coverage rate of the reflection layer 130 at the central region 114 may be more than the coverage rate of the reflection layer 130 at the second circular region 118. In the embodiment, since the region of the light incident surface 110 covered by the reflection layer 130 corresponds to the light pattern irradiated on the light incident surface 110 by the light emitting device 200, the intensity of the light beam emitted from the light emitting device 200 in a paraxial region (i.e. the region near the main optical axis T) is higher than the intensity thereof in a abaxial region (i.e. the region away from the main optical axis T) in general. Therefore, the light intensity irradiated on the pattern region 112 by the light emitting device 200 is decreased from the central position to outside. Also, in the embodiment, since the coverage rate of the reflection layer 130 at the central region 114 is larger than the coverage rate of the reflection layer 130 at the second circular region 118, the intensity of the light beam penetrating the central region 114 and the second circular region 118 may be similar, thereby increasing the light source uniformity of the light source module 300.

At the same time, since the intensity of the light beam emitted from the light emitting device 200 in the paraxial region (i.e. the region near the main optical axis T) is higher than the intensity thereof in the abaxial region (i.e. the region away from the main optical axis T) in general, the coverage rates of the reflection layer 130 at the first circular regions 116A and 116B are different from each other, and the coverage rate thereof is decreased from the central position to outside. In particular, the coverage rate of the reflection layer 130 at the first circular region 116A is more than the coverage rate of the reflection layer 130 at the first circular region 116B. That is, the distribution of the reflection layer 130 may correspond to the light intensity distribution of the light emitting device 200 decreased outwardly. Thus, the light beam emitted from the light emitting surface 120 of the optical diffusion plate 100 has a good uniformity.

Referring to FIG. 1B and FIG. 2, in the first embodiment of the invention, the optical lens 220 has a top surface face to the light incident surface 110. For example, the top surface of the optical lens 220 of the embodiment is, for example, the light emitting concave surface 223, and a radius of the top surface (the light emitting concave surface 223) on a plane perpendicular to the optical axis T is R. Also, the position of the first circular region 116A is disposed in a range of $(R-5) \leq S \leq (R+10)$, wherein S is a distance between the first circular region 116A and the central position of the pattern region 112 (or the position of the optical axis T), and a unit of R and S is mm (millimeter). Therefore, the position of the first circular region 116A may appropriately correspond to the region of the light incident surface 110 irradiated by the light emitting device 200 with a lower intensity.

In the first embodiment of the invention, an absorption rate of the reflection layer 130 is less than 50%, and a reflection rate of the reflection layer 130 is in a range of 10% to 90%. In particular, the reflection layer 130 is, for example, a white reflection layer. The reflection layer 130 is used for reflecting the light beam from the light emitting device 200. However, the invention is not limited thereto. In other embodiments, the reflection layer 130 may be a mirror reflection layer, so as to increase the reflection rate of the reflection layer 130. The reflection layer 130 may be the reflection layer having other color, so as to absorb the light beam in parts of the wavelength spectrum in the light beam emitted from the light emitting device 200. Furthermore, the color quality of the light beam emitted from the light source module 300 is also improved. In yet another embodiment, in order to make the reflection layer 130 has an appropriate absorption rate, the optical diffusion plate 100 further includes light absorbing particles doped in at least a portion of the reflection layer 130. However, the invention is not limited thereto.

The component notations and partial details of the structures hereinafter provided in the embodiments can be the same as or similar to the previous embodiment, wherein the same notations represent the same or similar components while the repeated same details are omitted, which can refer to the previous embodiment.

Figure 3:
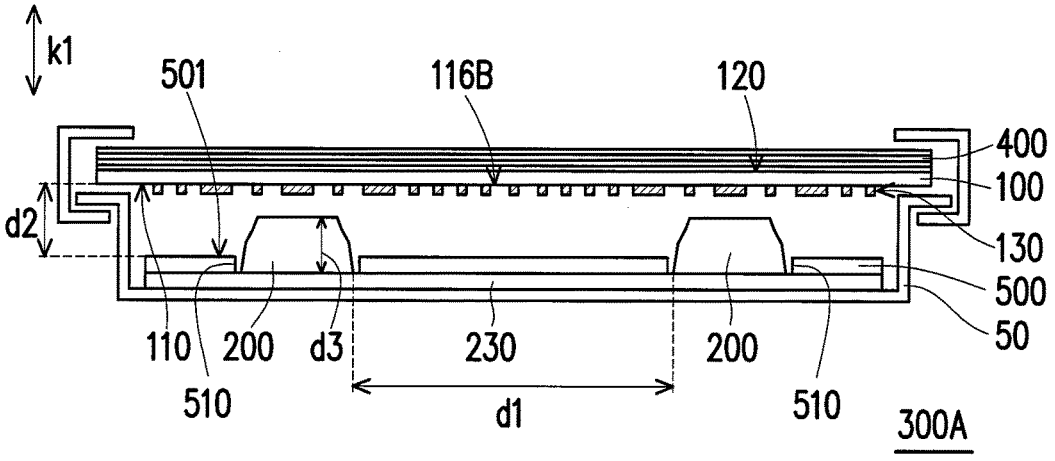
FIG. 3 is a schematic cross-sectional view of a light source module according to a second embodiment of the invention.

FIG. 3 is a schematic cross-sectional view of a light source module according to a second embodiment of the invention. Referring to FIG. 3, a light source module 300A of the second embodiment of the invention is approximately similar to the light source module 300 of the aforementioned embodiments, and the difference therebetween is: the light source module 300A of the second embodiment of the invention further includes an optical film set 400, a reflection sheet 500, a circuit plate 230 for disposition of a plurality of the light emitting devices 200, and a lamp box 50.

The light emitting device 200 of the embodiment is electrically connected to the circuit plate 230, so as to form a light bar to provide the light beam. The lamp box 50 provides an accommodation space for accommodating the light emitting device 200 and the circuit plate 230, a distance between the light emitting devices 200 and the optical diffusion plate 100 may be the same.

The reflection sheet 500 of the embodiment has an opening 510, and the reflection sheet 500 is disposed at one side of the optical diffusion plate 100 near the light incident surface 110. Further, the light emitting device 200 is disposed in the opening 510. A reflection surface 501 of the reflection sheet 500 is used to reflect the light beam from the light emitting device 200 and the light beam reflected by the reflection layer 130, and a light cavity between the reflection sheet 500 and the optical diffusion plate 100 provides a good light mixing effect. Therefore, the light beam may enter the optical diffusion plate 100 with a uniform intensity.

On the other hand, since the light cavity between the reflection sheet 500 and the reflection layer 130 of the embodiment may reflect the light beam from the light emitting device 200 back and forth, a distance d1 between the light emitting devices 200 may be increased. Thus, the manufacturing difficulty and the manufacturing cost of the light source module 300A are decreased, and the manufacturing yield of the overall is increased.

Since the reflection sheet 500 and the reflection layer 130 of the embodiment may reflect the light beam from the light emitting device 200 back and forth, and at the same time, the position of the reflection layer 130 disposed at the pattern region of the light incident surface 110 has the light pattern corresponding to the light emitting device 200, a distance (thickness) d2 of the light cavity between the reflection sheet 500 and the light incident surface 110 may be further decreased, so as to form a thin light cavity. In particular, the distance d2 of the embodiment is less than or equal to 15 mm, for example, 8 mm. However, the invention is not limited thereto. In an embodiment, a ratio between the distance d2 and the distance d1 is, for example, less than or equal to 0.2. However, the invention is not limited thereto.

Referring to FIG. 2 and FIG. 3, on a direction k1 parallel to a normal vector of the light incident surface 110, a height d3 of the optical lens 220 on the direction k1 is less than or equal to the distance d2 between the reflection sheet 500 and the light incident surface 110. When the height d3 of the optical lens 220 is equal to the distance d2 between the reflection sheet 500 and the light incident surface 110, the optical lens 220 may be used to support the optical diffusion plate 100.

In an embodiment (referring to FIG. 1B, FIG. 2 and FIG. 3), the radius R of the optical lens 220 is, for example, 6.5 mm, the position of the first circular region 116A is disposed in the distance S between the first circular region 116A from the central position of the pattern region 112, and the distance S is, for example, in a range of 2.5 to 16.5 mm. Furthermore, when the distance d2 between the reflection sheet 500 and the light incident surface 110 is, for example, 10 mm, and the distance S of the first circular region 116A is, for example, between 3 and 7 mm. When the distance d2 between the reflection sheet 500 and the light incident surface 110 is, for example, 15 mm, and the distance S of the first circular region 116A is, for example, between 9 and 15 mm. That is, the position of the first circular region 116A is adjusted according to the distance d2 between the reflection sheet 500 and the light incident surface 110. Additionally, when the radius R of the optical lens 220 is less than 5 mm, for example, the position of the first circular region 116A is disposed in a range of $0 \leq S \leq (R+10)$. The above is illustrated as an example; however, the invention is not limited thereto.

Referring to FIG. 1A, FIG. 1B, and FIG. 3, the first circular region 116B on the light incident surface 110 is located between two light emitting devices 200, and the first circular region 116B may be connected to the pattern regions corresponding to the two light emitting devices 200 in the embodiment. Since the intensity of the light beam received by the light incident surface 110 located at the first circular region 116B is the lowest, the coverage rate of the reflection layer 130 at the first circular region 116B is the lowest. Thus, the light beam entering the first circular region 116B is increased.

The optical film set 400 of the embodiment is disposed on the light emitting surface 120, and the optical film set 400 is used to accept the light beam from the light emitting surface 120, thereby improving the quality of the light beam from the light emitting surface 120. The optical film set 400 includes, for example, a brightness enhancing film, a filter, or a polarizing sheet. However, the invention is not limited thereto.

Figure 4A:
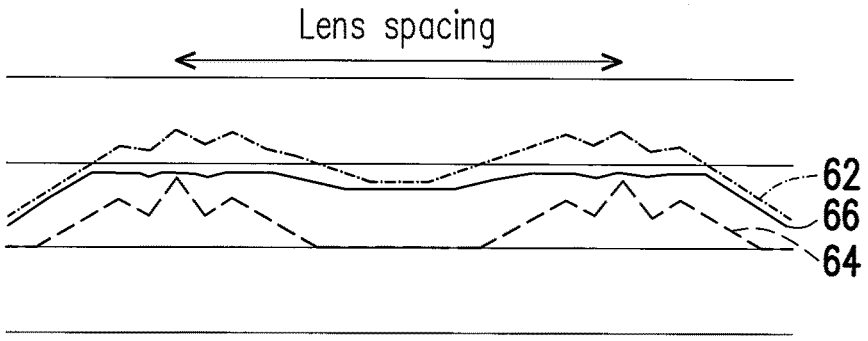
FIG. 4A is a schematic view of a light pattern distribution and a reflection layer distribution on an optical diffusion plate according to the second embodiment of the invention.

FIG. 4A is a schematic view of a light pattern distribution and a reflection layer distribution on an optical diffusion plate according to the second embodiment of the invention. Referring to FIG. 3 and FIG. 4A, the light distribution curve 62 superimposed by the adjacent light emitting devices 200 indicates that the light intensity distribution of the light beams emitted from the adjacent light emitting devices 200 without reflecting through the reflection layer 130. It can be known from the reflection layer distribution curve 64 that the distribution density of the reflection layer 130 at the light incident surface 110 is increased with the increasing of the light distribution curve 62 superimposed by the adjacent light emitting devices 200. That is, the distribution of the reflection layer 130 corresponds to the light pattern projected to the light incident surface 110 from the light emitting devices 200. Then, when the reflection layer 130 is disposed at the light incident surface, it can be known from the light intensity distribution curve 66 located at the light emitting surface 120 that the optical diffusion plate 100 of the embodiment may provide a good light uniformization effect by the reflection layer 130.

Figure 4B:
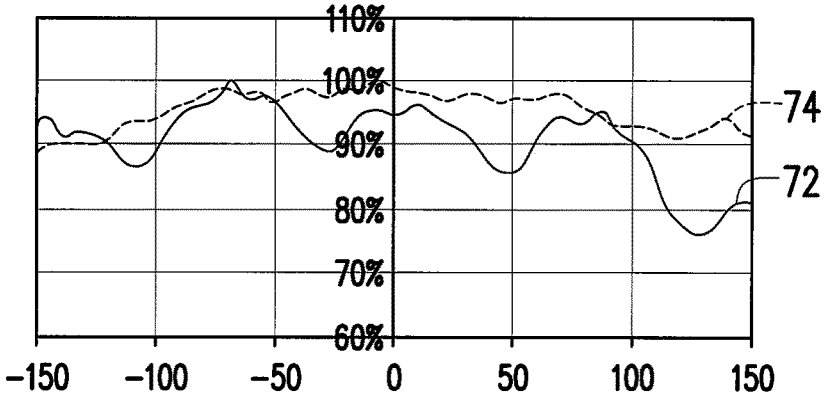
FIG. 4B is a schematic view of a luminance distribution of a light beam provided by a light source module according to another embodiment of the invention.

FIG. 4B is a schematic view of a luminance distribution of a light beam provided by a light source module according to another embodiment of the invention. Referring to FIG. 4B, the uniformity of the luminance distribution curve 72 of the light source module without the reflection layer is significantly lower than the uniformity of the luminance distribution curve 74 of the light source module with the reflection layer. That is, the light source module of the embodiment of the invention can provide a light source with a good uniformity.

Hereinafter, other embodiments of the invention are listed to illustrate the detailed features of the reflection layer of the embodiments of the invention.

Figure 5A:
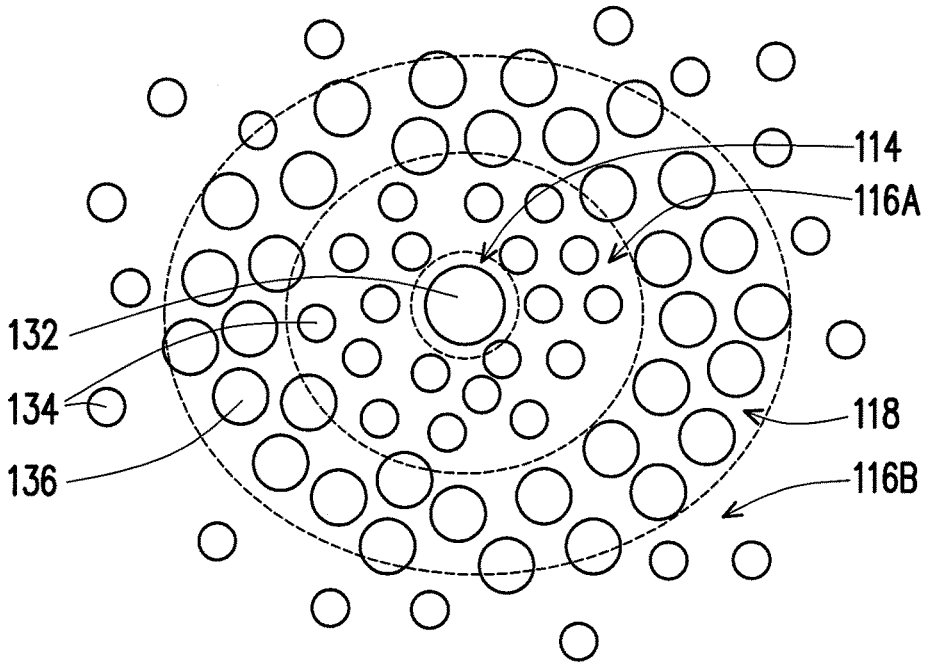
FIG. 5A is a partial schematic bottom view of a pattern region according to a third embodiment of the invention.

FIG. 5A is a partial schematic bottom view of a pattern region according to a third embodiment of the invention. Referring to FIG. 5A, in the third embodiment of the invention, the reflection patterns 132, 134 and 136 of the reflection layer have the same shape, such as a circle. The area of the reflection pattern 132 located at the central region 114 and the area of the reflection pattern 136 located at the second circular region 118 are larger than the area of the reflection pattern 134 at the first circular regions 116A and 116B, and thus the reflection rate of the second circular region 118 and the central region 114 may be higher than the reflection rate of the first circular regions 116A and 116B by covering the larger area on the light incident surface.

Figure 5B:
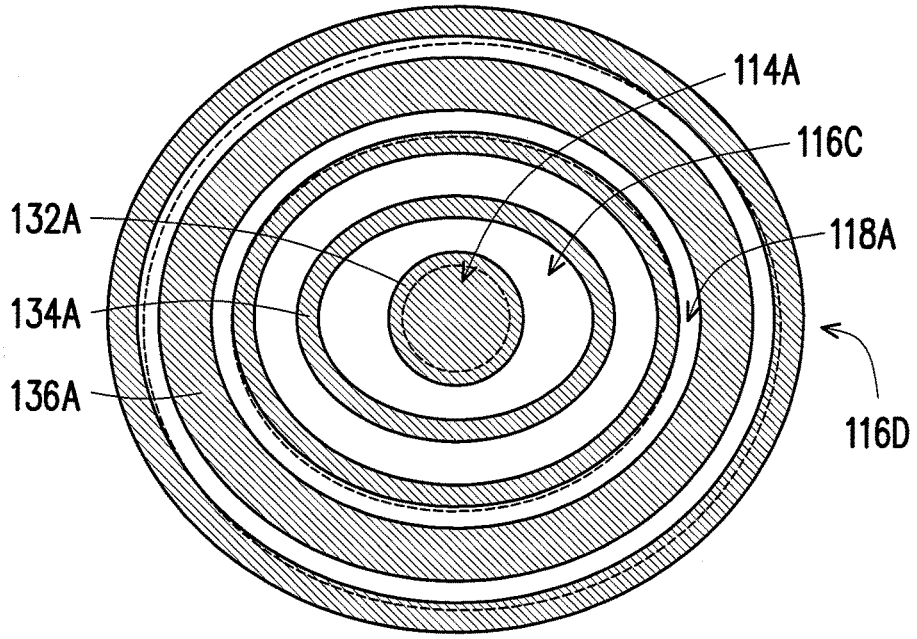
FIG. 5B is a partial schematic bottom view of a pattern region according to a fourth embodiment of the invention.

Specifically, to illustrate the detailed features of the pattern region of the embodiment clearly, parts of elements shown in FIG. 5A are amplified. However, it is not used to limit the size, the position, or the shape of the elements of the invention. In the third embodiment of the invention, the radius of the reflection patterns 132, 134 and 136 is less than or equal to 1.5 mm substantially, and the area of the reflection pattern 132 located at the central region 114 of the central position of the pattern region is larger than the area of the reflection pattern 136 located at the second circular region 118. Additionally, the distribution density of the reflection pattern 134 located at the first circular region 116A is more than the distribution density of the reflection pattern 134 located at the first circular region 116B. Therefore, the size and the distribution density of the reflection patterns 132, 134 and 136 in the pattern region of the embodiment may be adjusted to moderately adjust the coverage rate thereof. Also, since the optical diffusion plate of the embodiment of the invention has the aforementioned reflection layer, the optical diffusion plate has a good degree of freedom to match with any light pattern of the light emitting device. Additionally, in the third embodiment of the invention, the reflection pattern 134 is distributed in the first circular region 116A uniformly, for example. However, in other embodiments, the distribution density of the reflection pattern 134 at the first circular region 116A may be increased gradually and then decreased gradually in a direction from the central region 114 to the second circular region 118. However, the invention is not limited thereto. FIG. 5B is a partial schematic bottom view of a pattern region according to a fourth embodiment of the invention. Referring to FIG. 5B, the reflection pattern of the reflection layer of the optical diffusion plate of the embodiment of the invention is not limited to the aforementioned reflection patterns 132, 134 or 136. In the fourth embodiment of the invention, a reflection pattern 132A located at the central region 114A is a reflection disc, and the reflection patterns 134A and 136A located at the first circular regions 116C and 116D and the second circular region 118A is a reflection ring surrounding the reflection disc. Since the reflection patterns 134A and 136A may be disposed in the first circular regions 116C and 116D and the second circular region 118A or between the two adjacent regions to achieve the desired coverage rate of each region, the manufacturing difficulty of the reflection layer formed by the reflection patterns 132A, 134A and 136A may be decreased, thereby increasing the manufacturing yield of the overall optical diffusion plate.

Figure 6A:
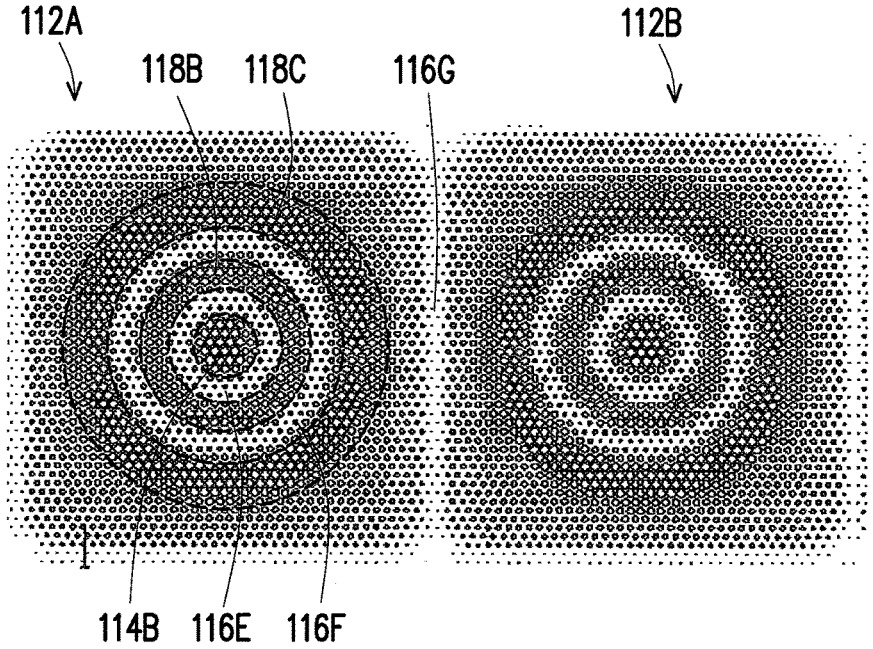
FIG. 6A is a schematic bottom view of a pattern region according to a fifth embodiment of the invention.

FIG. 6A is a schematic bottom view of a pattern region according to a fifth embodiment of the invention. Referring to FIG. 6A, in the fifth embodiment of the invention, the distance between two adjacent reflection patterns in the reflection patterns located at the central region 114B, the first circular regions 116E and 116F, and the second circular regions 118B and 118C is the same. The reflection patterns may be formed on the light incident surface of the optical diffusion plate in a way of dot by a printing method, for example, and at the same time, the coverage rate of each region is adjusted by setting the size of each dot in the central region 114B, the first circular regions 116E and 116F, and the second circular regions 118B and 118C respectively. Thus, the light beam penetrating the optical diffusion plate may have a good uniformity.

A first circular region 116G is connected between the pattern region 112A and the pattern region 112B. The light beam irradiated to the first circular region 116G has the lowest intensity when the light beam is irradiated along the central region of the pattern region 112A and the central region of the pattern region 112B. Therefore, the coverage rate of the reflection pattern of the first circular region 116G is lower than the coverage rate of the reflection pattern of other regions of the pattern regions 112A and 112B, so that the overall optical uniformity may be increased.

In the embodiment, the disposition of the reflection patterns located at the pattern region 112A and the pattern region 112B are circular symmetry in each of the pattern regions 112A and 112B, and the reflection patterns may be disposed corresponding to the light pattern of the light beam emitted from the two light emitting devices respectively.

Figure 6B:
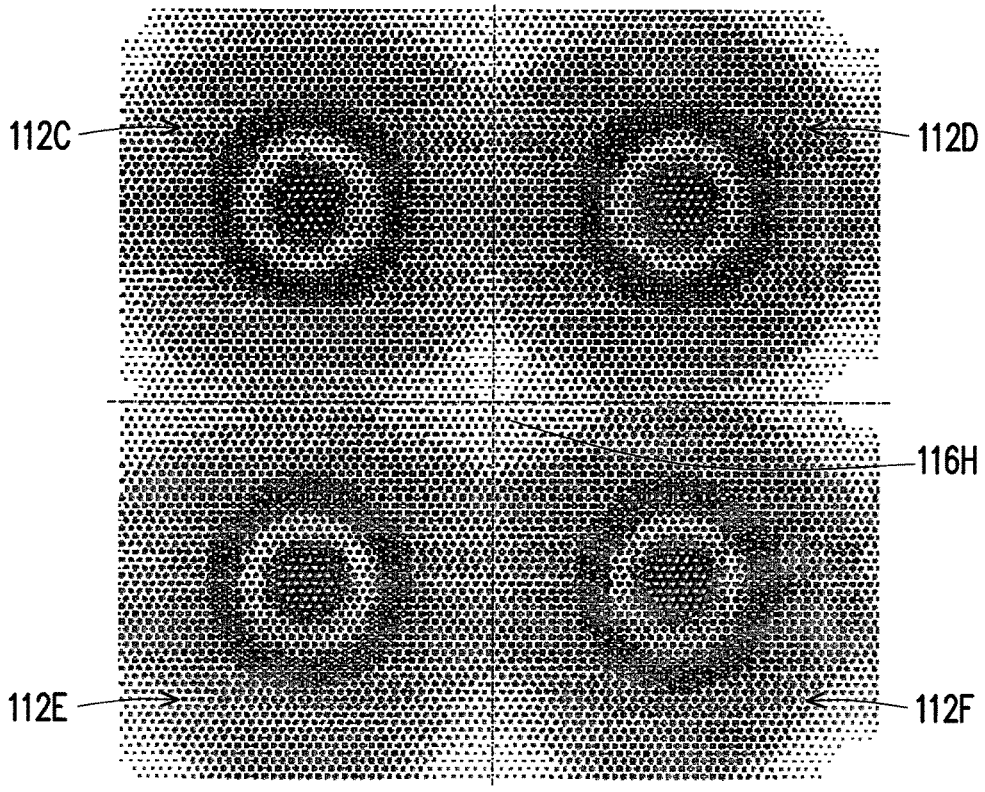
FIG. 6B is a schematic bottom view of a pattern region according to a sixth embodiment of the invention.

FIG. 6B is a schematic bottom view of a pattern region according to a sixth embodiment of the invention. Referring to FIG. 6B, the reflection layer of the sixth embodiment of the invention has four pattern regions 112C, 112D, 112E and 112F, and thus the first circular region 116H is located between the four pattern regions 112C, 112D, 112E and 112F. Also, the coverage rate of the reflection pattern at the first circular region 116H is lower compared to the coverage rate of the reflection pattern at the four pattern regions 112C, 112D, 112E and 112F. Therefore, the light beam penetrating the four pattern regions 112C, 112D, 112E and 112F may have a good uniformity.

In the aforementioned embodiment of the invention, the reflection pattern disposed in the first circular region of the pattern region has a smaller area or a sparse distribution. However, the invention is not limited thereto. In other embodiments, the first circular regions of the pattern region on the light incident surface of the optical diffusion plate may increase the transmission rate thereof by exposing the light incident surface directly.

In summary, the embodiments of the invention have at least one of the following advantages or effects. The optical diffusion plate of the embodiment of the invention has the reflection layer covering the pattern region of the light incident surface or the light emitting surface, and the pattern region includes the central region and the first circular region and the second circular region surrounding the central region. Since the coverage rate of the reflection layer at the central region and the first circular region is higher, the reflection layer may reflect a portion of the light beam when the external light beam is irradiated along the central region of the pattern region. Thus, the light beam emitted from the light incident surface may have a good uniformity. Since the light source module of the embodiments of the invention has the aforementioned optical diffusion plate, the distance between the light emitting device and the optical diffusion plate may be decreased. At the same time, the distance between the light emitting devices may be increased by the reflection of the reflection layer. Therefore, the light source module can provide a good illumination light beam when the thickness of the overall light source module is decreased. Furthermore, the manufacturing cost of the light source module is decreased, and the manufacturing yield of the light source module is increased.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A light source module, comprising:

an optical diffusion plate comprising:

a light incident surface;

a light emitting surface being opposite to the light incident surface;

at least one pattern region located on at least one of the light incident surface and the light emitting surface; and a reflection layer covering at least a portion of the pattern region, wherein the pattern region comprises a central region, a plurality of first circular regions, and at least one second circular region, the central region is located at a central position of the pattern region, the central region is surrounded by the first circular regions and the at least one second circular region alternatively, perimeter of the central region is adjacent to one of the first circular regions, and coverage rates of the reflection layer at the at least one second circular region and the central region are higher than coverage rates of the reflection layer at the first circular regions, at least one light emitting device disposed at one side of the optical diffusion plate near the light incident surface, and a position of the light emitting device corresponds to the pattern region, wherein the light emitting device comprises a light emitting unit and an optical lens, the light emitting unit is capable of emitting a light beam, the light beam is transmitted to the light incident surface through the optical lens, and the central position is located on a main optical axis of the optical lens, wherein the optical lens has a top surface facing the light incident surface, a position of one of the first circular regions is disposed in a range of $(R-5) \leq S \leq (R+10)$, wherein R is a radius of the top surface, S is a distance between the first circular region and the central position, and a unit of R and S is mm.

2. The light source module of claim 1, wherein a light pattern of the light beam at the light incident surface corresponds to positions of the central region, the first circular regions, and the at least one second circular region at the pattern region.

3. The light source module of claim 1, further comprising a reflection sheet disposed at the side of the optical diffusion plate near the light incident surface, the reflection sheet has at least one opening, and the light emitting device is disposed in the opening.

4. The light source module of claim 3, wherein a distance between the reflection sheet and the light incident surface is less than or equal to 15 mm.

5. The light source module of claim 1, wherein the reflection layer comprises a plurality of reflection patterns disposed in the pattern region, and regions occupied by the reflection patterns in a unit area of the central region and a unit area of the at least one second circular region are larger than a region occupied by the reflection patterns in a unit area of the first circular regions.

6. The light source module of claim 5, wherein a disposition of the reflection patterns at the pattern region is circular symmetry.

7. The light source module of claim 5, wherein a radius of the reflection patterns is equal to or less than 1.5 mm.

8. The light source module of claim 5, wherein the reflection pattern located at the central region is a reflection disc, the reflection pattern located at the second circular region is reflection ring, and the reflection disc is surrounded by the reflection ring.

9. The light source module of claim 5, wherein the reflection patterns have the same shape.

10. The light source module of claim 5, wherein a distance between two adjacent reflection patterns in the reflection patterns is the same.

11. The light source module of claim 1, further comprising light absorbing particles doped in at least a portion of the reflection layer.

12. The light source module of claim 1, wherein an absorption rate of the reflection layer is less than 50%.

13. The light source module of claim 1, wherein a reflection rate of the reflection layer falls in a range of 10% to 90%.

14. The light source module of claim 1, wherein the coverage rate of the reflection layer at the central region is higher than the coverage rate of the reflection layer at the second circular region.

15. The light source module of claim 1, wherein the coverage rates of the reflection layer at the first circular regions are different from each other, and the coverage rates are decreased from the central position to outside.

* * * * *